US007554431B2

(12) United States Patent
Dahlgren et al.

(10) Patent No.: US 7,554,431 B2
(45) Date of Patent: Jun. 30, 2009

(54) MULTIPHASE INDUCTION DEVICE

(75) Inventors: Mikael Dahlgren, Vasteras (SE); Udo Fromm, Stuttgart (DE); Gunnar Russberg, Vasteras (SE); Christian Sasse, Vasteras (SE); Anders Eriksson, Vasteras (SE); Tomas Jonsson, Uppsala (SE); Svante Soderholm, Vasteras (SE)

(73) Assignee: ABB AB, Vasteras (SE)

( * ) Notice: Subject to any disclaimer, the term of this patent is extended or adjusted under 35 U.S.C. 154(b) by 0 days.

(21) Appl. No.: 11/252,873

(22) Filed: Oct. 19, 2005

(65) Prior Publication Data

US 2006/0087393 A1 Apr. 27, 2006

Related U.S. Application Data

(63) Continuation of application No. 10/239,866, filed as application No. PCT/EP01/04402 on Apr. 2, 2001, now abandoned.

(30) Foreign Application Priority Data

Apr. 3, 2000 (GB) ..... 0008151.3
Apr. 3, 2000 (GB) ..... 0008156.2

(51) Int. Cl.
*H01F 27/24* (2006.01)

(52) U.S. Cl. ..... 336/233

(58) Field of Classification Search ..... 336/83, 336/175, 212, 214–216, 233–234
See application file for complete search history.

(56) References Cited

U.S. PATENT DOCUMENTS

| | | | | |
|---|---|---|---|---|
| 5,047,715 | A * | 9/1991 | Morgenstern | 324/207.17 |
| 5,581,224 | A * | 12/1996 | Yamaguchi | 336/212 |
| 6,791,447 | B2 * | 9/2004 | Scheible et al. | 336/221 |
| 6,873,237 | B2 * | 3/2005 | Chandrasekaran et al. | 336/83 |

FOREIGN PATENT DOCUMENTS

| | | |
|---|---|---|
| WO | WO 97/45847 | 12/1997 |
| WO | WO 97/45918 | 12/1997 |
| WO | WO 97/45919 | 12/1997 |
| WO | WO 97/45930 | 12/1997 |
| WO | WO 97/45931 | 12/1997 |
| WO | WO 99/17315 | 4/1999 |

OTHER PUBLICATIONS

A.A. Martynov, et al, "The Inductive Reactance of a Rotating Magnetic Field Multiphase Transformer with Yoke Magnetization", Electrical Technology, No. 2, pp. 39-47, 1994, no month/date.

* cited by examiner

*Primary Examiner*—Tuyen T. Nguyen
(74) *Attorney, Agent, or Firm*—Oblon, Spivak, McClelland, Maier & Neustadt, P.C.

(57) ABSTRACT

An induction device having windings of different phases arranged around magnetic core limbs. The magnetic core limbs are connected by at least one body formed from magnetic particles in a matrix of a dielectric material.

13 Claims, 11 Drawing Sheets

MULTIPHASE INDUCTION DEVICE

BACKGROUND TO THE INVENTION

The present invention relates to an induction device, such as a reactor or transformer, having a plurality of phases.

The invention is particularly applicable to a large reactor for use in a power system, for example in order to compensate for the Ferranti effect in long overhead lines or extended cable systems causing high voltages under open circuit or lightly loaded conditions. Reactors are sometimes required to provide stability to long line systems. They may also be used for voltage control and switched into and out of the system during lightly loaded conditions.

Transformers are used in power systems to step up and step down voltages to useful levels.

A typical known induction device comprises one or more coils wrapped around a laminated core to form windings, which may be coupled to the line or load and switched in and out of the circuit. The equivalent magnetic circuit of a static induction device comprises a source of magnetomotive force, which is a function of the number of turns in the winding, in series with the reluctance of the core, which may include iron and optionally an air gap.

The air gap represents a weak link in the structure of the core, which tends to vibrate at a frequency twice that of the alternating input current. This is a source of vibrational noise and high mechanical stress. Another problem associated with the air gap is that the magnetic field fringes, spreads out and is less confined. Thus, field lines tend to enter and leave the core with a non-zero component transverse to the core laminations which can cause a concentration in unwanted eddy currants and hot spots in the core.

It is known to alleviate these problems by placing one or more inserts in the air gap, for example comprising radially laminated steel plates and ceramic spacers. However, such inserts are complicated and difficult to manufacture and are therefore expensive.

It is known to provide a plurality of windings of different phases on a transformer or solenoid having a yoke similar to the stator of an asynchronous machine. See A. A. Martynov and V. V. Krushchev, "The Inductive Reactance of a Rotating Magnetic Field Multiphase Transformer with Yoke Magnetization", Electrical Technology, No. 2, pp 39-47, 1994.

Preferably, the device of the invention is a high voltage device. In this specification, the term "high voltage" is intended to mean in excess of 2 kV and preferably in excess of 10 kV. The invention also relates to a method of regulating a high voltage induction device.

In WO-A-99/17315 there is disclosed an arrangement for regulating an induced voltage in a transformer or regulating the reactive power of a reactor. In this known arrangement the transformer/reactor has a flux carrier about which is arranged a regulating winding. The number of turns of the regulating winding arranged around the flux carrier can be adjusted to alter the electrical properties of the transformer/reactor.

SUMMARY OF THE INVENTION

It is an aim of the invention to provide a multiphase induction device having the advantages but not the disadvantages of air gaps.

Accordingly, the present invention provides an induction device comprising windings of different phases arranged around magnetic core limbs, characterised in that the magnetic core limbs are connected by at least one body comprising magnetic particles in a matrix of a dielectric material. In this specification the material of the body is identified by the term "distributed air gap material". The material has a magnetic permeability low enough to prevent saturation of the magnetic core limbs but high enough to provide a preferred path for magnetic flux. For example, the relative magnetic permeability of the distributed air gap material may be between 2 and 10. In a particularly preferred distributed air gap material the magnetic particles are of iron, amorphous iron based materials, alloys of Ni—Fe, Co—Fe, Fe—Si and the like, or ferrites based preferably on at least one of manganese, zinc, nickel and magnesium (and preferably alloys such as Mn—Zn, Ni—Zn or Mn—Mg), and matrix of the dielectric material may be of an epoxy resin, polyamide, polyimide, polyethylene, cross-inked polyethylene, polytetrafluoroethylene and polyformaldehyde sold under the trade mark "Teflon" by DuPont, rubber, ethylene propylene rubber, acrylonitrile-butadiene-styrene, polyacetal, polycarbonate, polymethyl methacrylate, polyphenylene sulphone, PSU, polyetherimide, polyetheretherketone or the like, or concrete or foundry sand, or a fluid such as water or a gas. The magnetic particles may be coated with a dielectric material, for example a metal oxide or other inorganic compound.

The magnetic particles may have a size of about 1 nm to about 1 mm and preferably about 0.1 μm to about 200 μm.

The core limbs are made from a material of high magnetic permeability such as iron, laminated electrical steel, magnetic wires or ribbons, or highly compacted soft magnetic powder. In certain three-phase embodiments of the invention, the core limbs of the three phases are mutually orthogonal and the device comprises six limbs, each phase comprising two limbs on opposite sides of the body. Alternative embodiments of the invention comprise radial limbs of different phases equally spaced around a central body. In such embodiments there may be an outer annular core section or each limb may comprise an outer parallel portion, with two central bodies, one at each end of each limb. In further embodiments a plurality of parallel limbs interconnect two distributed air gap material bodies at either end of the device.

The distributed air gap material body may exhibit anisotropy in its magnetic permeability. Additionally, the body may comprise concentric rings or sectors of greater and lower magnetic permeability, or evenly distributed pockets of greater or lower magnetic permeability. Manufacture of such bodies is facilitated by forming them from a number of members of substantially uniform cross-section, which may be substantially identical in shape and size, at least one of the members having a different magnetic permeability from the others. The members can comprise strands of solid material, wires, powder filled hoses or pipes, or rolls of ribbon.

Preferably, the conductor used for the windings comprises central conductive strands, surrounded in turn by an inner semiconductive layer, an insulating layer and an outer semiconductor layer.

In induction devices according to embodiments of the invention the magnetic field rotates in the body instead of reciprocating. A combination of rotating and reciprocating magnetic fields may also occur. This combination of fields can have lower losses than a reciprocating field alone.

The body provides an "air gap region" shared by all of the phases of the device which is an economical use of distributed air gap material.

According to an embodiment of the present invention the device is a high voltage induction device and the magnetic core limbs are further connected by inner and outer magnetic core parts, and a plurality of regulating windings are each arranged to be wound between the inner and outer magnetic core parts, adjusting means being provided for adjusting the proportions of each regulating winding wound on the inner and outer magnetic core parts.

Preferably the inner and outer magnetic core parts are arranged substantially coaxially of each other and the core limbs are arranged substantially radially.

Conveniently the adjusting means are intended to permit each regulating winding to be wound between the inner and outer magnetic core parts so that the regulating winding is fully wound on the inner magnetic core part, is fully wound on the outer magnetic core part or is partially wound on both the inner and outer magnetic core parts.

Suitably this is achieved by having, for each regulating winding, inner and outer drums rotatably mounted on the inner and outer core parts and means for rotating the drums for winding the regulating winding onto one of said drums and unwinding the second winding from the other of said drums.

Preferably each regulating winding comprises inner electrically conducting means, a first semiconducting layer surrounding the inner electrically conducting means, a solid electrically insulating layer surrounding the first semiconducting layer and a second semiconducting layer surrounding the insulating layer. The second windings may be formed from cables having solid, extruded insulation, of a type now used for power distribution, such as XLPE-cables or cables with EPR-insulation. Such cables are flexible, which is an important property in this context since the winding is formed from cable which is bent during assembly. The flexibility of an XLPE-cable normally corresponds to a radius of curvature of approximately 20 cm for a cable with a diameter of 30 mm, and a radius of curvature of approximately 65 cm for a cable with a diameter of 80 mm. In the present application the term "flexible" is used to indicate that the winding is flexible down to a radius of curvature in the order of twice the cable diameter, preferably four to eight times the cable diameter.

The flexible regulating windings should be constructed to retain their properties even when bent and when subjected to thermal or mechanical stress during operation. The material combinations stated above should be considered only as examples. Other combinations fulfilling the conditions specified and also the condition of being semiconducting, i.e. having resistivity within the range of 10-1-106 Ω.cm, e.g. 1-500 Ω.cm, or 10-200 Ω.cm, naturally also fall within the scope of the invention.

The insulating layer may consist, for example, of a solid thermoplastic material such as low-density polyethylene (LDPE), high-density polyethylene (HDPE), polypropylene (PP), polybutylene (PB), polymethyl pentene ("TPX"), crosslinked materials such as cross-linked polyethylene (XLPE), or rubber such as ethylene propylene rubber (EPR) or silicon rubber.

The inner and outer (first and second) semiconducting layers may be of the same basic material but with particles of conducting material such as soot or metal powder mixed in.

Ethylene-vinyl-acetate copolymers/nitrile rubber (EVA/NER), butyl graft polyethylene, ethylene-butyl-acrylate copolymers (EBA) and ethylene-ethyl-acrylate copolymers (EEA) may also constitute suitable polymers for the semiconducting layers.

The conductivity of the two semiconducting layers is sufficient to substantially equalize the potential along each layer. The conductivity of the outer semiconducting layer is sufficiently high to enclose the electrical field within the cable, but sufficiently low not to give rise to significant losses due to currents induced in the layer.

Thus, each of the two semiconducting layers essentially constitutes one equipotential surface, and these layers will substantially enclose the electrical field between them.

There is, of course, nothing to prevent one or more additional semiconducting layers being arranged in the insulating layer.

Examples of insulated conductors or cables suitable to be used in the present invention is described in more detail in WO-A-97/45919 and WO-A-97/45847. Additional descriptions of the insulated conductor or cable concerned can be found in WO-A-97/45918, WO-A-97/45930 and WO-A-97/45931.

According to another aspect of the present invention there is provided a method of regulating a high voltage induction device comprising windings of different phases arranged around magnetic core limbs, the magnetic core limbs being connected by at least one body comprising magnetic particles in a matrix of a dielectric material, the magnetic core limbs being further connected by inner and outer magnetic core parts, and regulating windings being wound between the inner and outer magnetic core parts, the method comprising transferring regulating conductor means between the inner and outer magnetic core parts to adjust the number of turns of the regulating conductor means wound on the inner and outer magnetic core parts.

A communications unit is preferably included in the induction device. The communications unit typically comprises at least one Input/Output (I/O) interface and a processor. Measured values for one or more sensors in the induction device may be received via the I/O interface and routed to the processor. An output channel of the I/O interface may be used to send a control signal to an actuator of any sort arranged in the induction device. The communications unit may also be used to send data out of the induction device by wire or wireless means, for supervision, data collection and/or control purposes. The communications unit may, for example, be mounted on the core.

BRIEF DESCRIPTION OF THE DRAWINGS

The invention will now be described in more detail, by way of example only, with reference to the accompanying drawings, in which:-

DETAILED DESCRIPTION OF THE PREFERRED EMBODIMENTS

Figure 1:
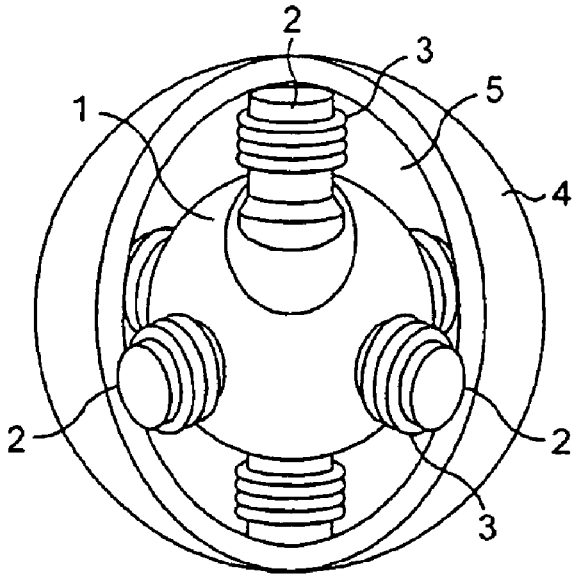
FIG. 1 is a schematic, cut away perspective view of a reactor according to a first embodiment of the invention.
Figure 2:
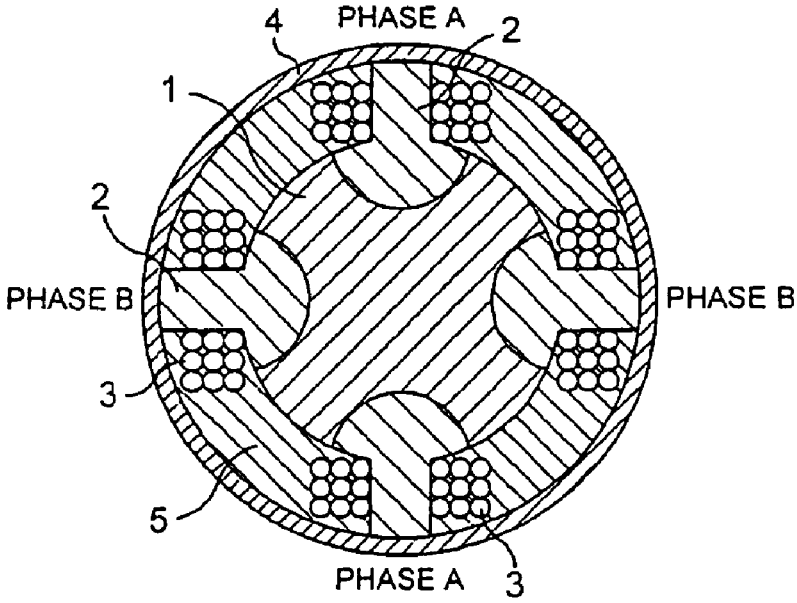
FIG. 2 is a schematic sectional view of the reactor shown in FIG. 1.

FIGS. 1 and 2 show a spherical three-phase reactor comprising a central substantially spherical body 1 of distributed air gap material. Six soft magnetic core limbs 2, lying along the major Cartesian co-ordinate axes, protrude from recesses in the body 1. More generally, the spherical reactor has 2n core limbs, spaced equiangularly, and in the embodiment shown n=3 and the limbs are spaced orthogonally. (In alternative embodiments there are 3n equiangularly spaced limbs.) However, n can be any natural number. Each core limb 2 carries a winding 3, with coaxial limbs carrying windings from the same phase, although the number of core limbs is not necessarily 2 per phase. An outer mantle 4 of ferrite, iron or other soft magnetic material closes the magnetic flux path and provides effective magnetic shielding. A fill material 5 with a relative magnetic permeability of approximately 1, such as concrete, may optionally fill the space between the body 1 and mantle 4.

Since the core limbs 2 are of high permeability material, the total length of the windings is relatively short.

The spherical shape of the reactor and the use of the fill material 5 confer good acoustic and mechanical strength properties on the reactor.

Figure 3:
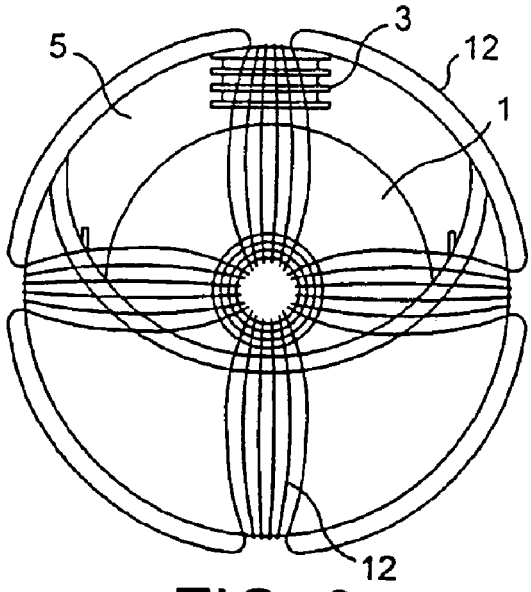
FIG. 3 is a schematic, cut away view of a reactor according to a second embodiment of the invention.
Figure 4:
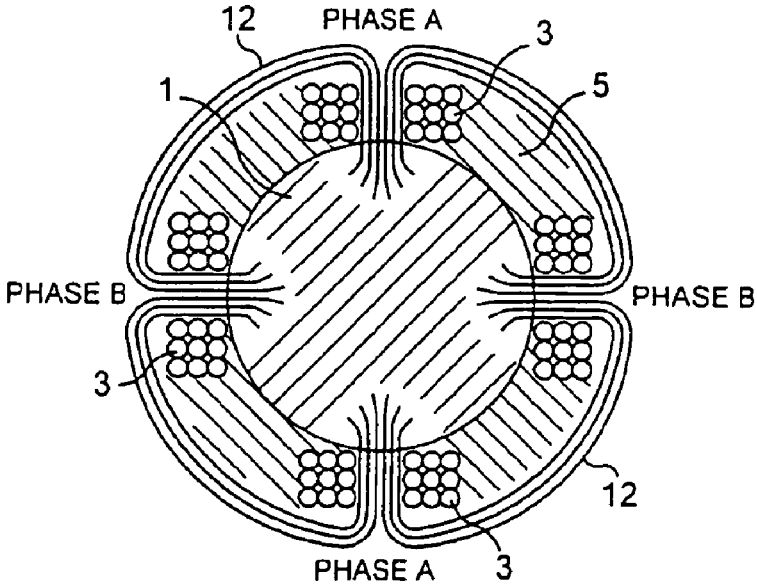
FIG. 4 is a schematic sectional view of the reactor shown in FIG. 3.

FIGS. 3 and 4 show a spherical reactor similar to that shown in FIGS. 1 and 2 but in which the core limbs and mantle have been replaced between bundles of magnetic wires 12. There are twelve bundles of wires arranged around the reactor and each winding 3 is wound around a group of four bundles, with each bundle being dimensioned to carry one quarter of the total magnetic flux in the phase. The magnetic flux is guided along a joint free and electromagnetically optimised path into and through the outer magnetic circuit and back into the distributed air gap body 1.

Figure 5:
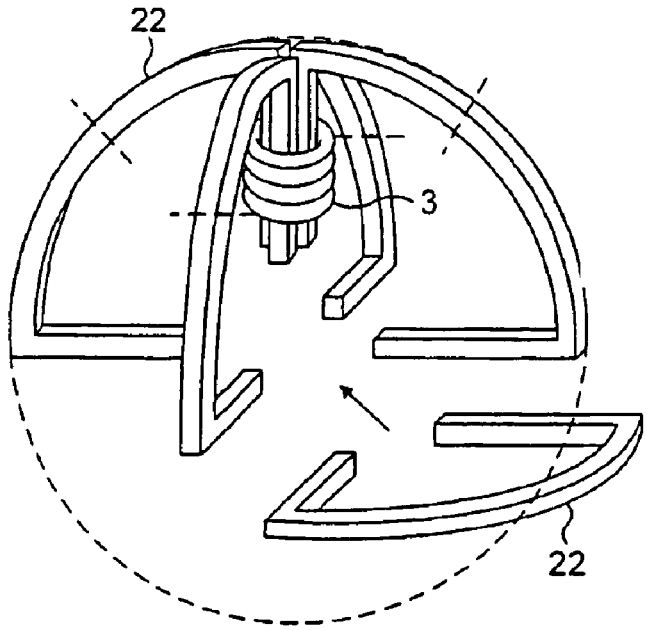
FIG. 5 is a perspective view showing partially assembled components of a reactor according to a third embodiment.
Figure 6:
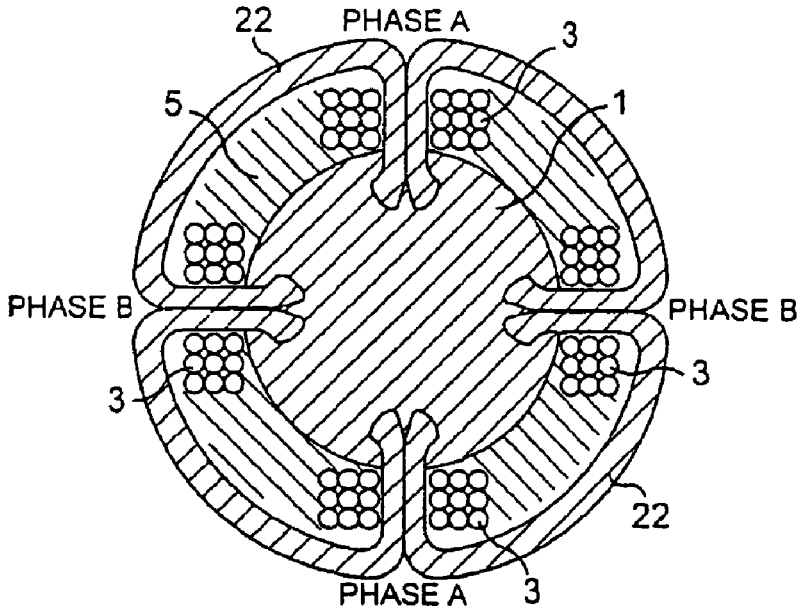
FIG. 6 is a schematic section view of the third embodiment.

FIGS. 5 and 6 show a further alternative spherical reactor comprising twelve solid quadrant shaped core segments 22. The core segments can be formed from laminated electrical steel plates or magnetic ribbons and each one is dimensioned to carry approximately one quarter of the magnetic flux. There are no joints in the outer magnetic circuit and production is relatively easy.

Figure 5A:
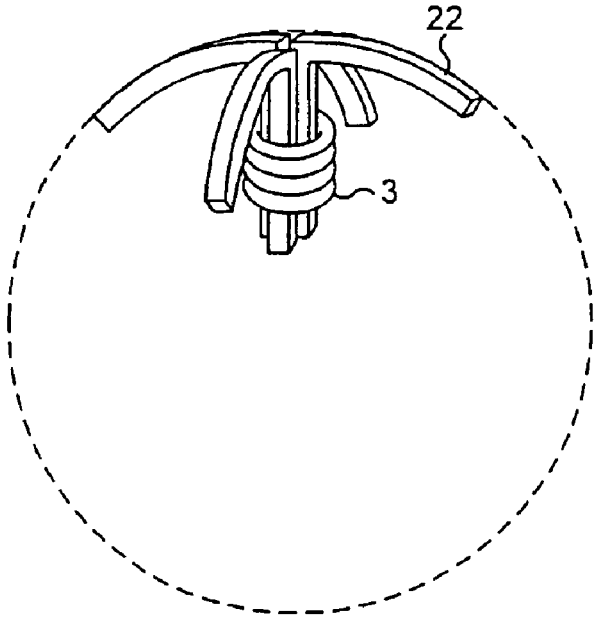
FIG. 5*a* is a perspective view showing partially assembled components of a modified reactor similar to the reactor shown in FIG. 5.

In order to enable the windings 3 to be wound more easily, the core segments 22 may be separated as shown in dashed lines in FIG. 5 to produce a number of separated core parts as shown in FIG. 5*a* It will be appreciated that the cut core parts will not interfere with the windings as they are being wound. After the winding operation has been completed, the separated core parts are re-assembled together.

FIGS. 7 to 9 and 11 to 13 show reactors in which the magnetic field rotates in a distributed air gap material body.

Figure 7:
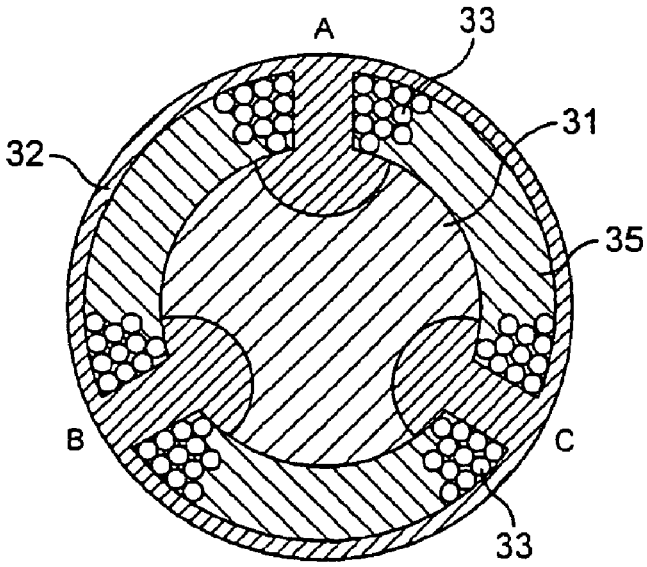
FIGS. 7, 8 and 9 are schematic sectional views of reactors according to fourth, fifth and sixth embodiments respectively.
Figure 8:
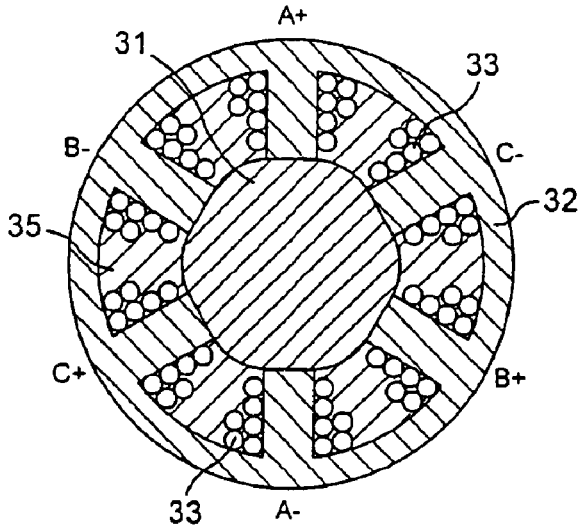
Figure 9:
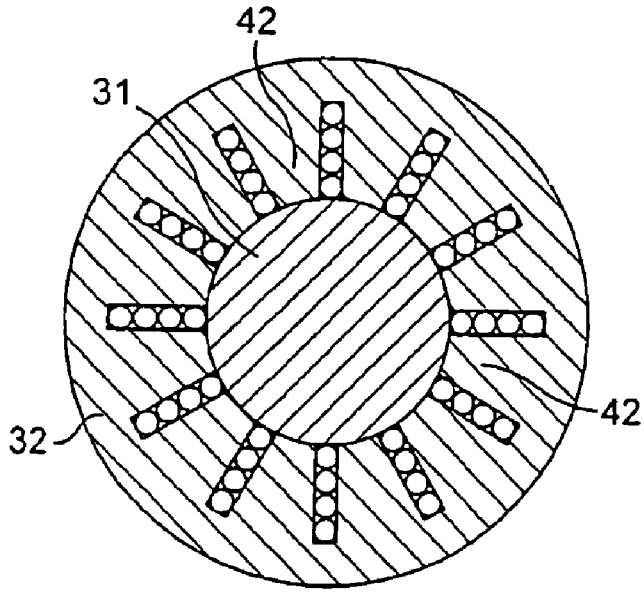

In FIGS. 7, 8 and 9, cylindrical reactors have outer cores 32 similar to the stators of known two-pole rotating machines and formed from laminated electrical steel or magnetic wires or ribbons. However, in place of the rotor is a stationary prismatic body 31 of distributed air gap material.

FIG. 7 shows a reactor having three core limbs, one for each phase and FIG. 8 shows a reactor having six core limbs, two for each phase. The phase windings 33 in FIGS. 7 and 8 are separate and the space between them is filled with a material 35 having a magnetic permeability of approximately 1, or between 0 and approximately 1.

Figure 7A:
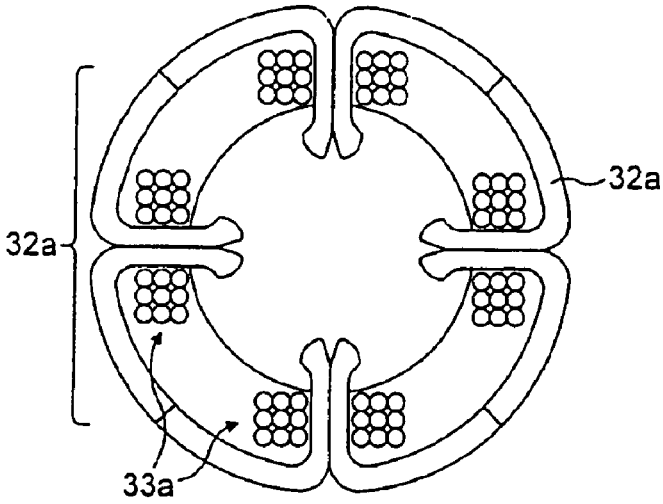
FIGS. 7*a*, 7*b*, 7*c* and 8*a* are schematic sectional views of modified versions of the reactors shown in FIGS. 7 and 8, respectively.
Figure 8A:
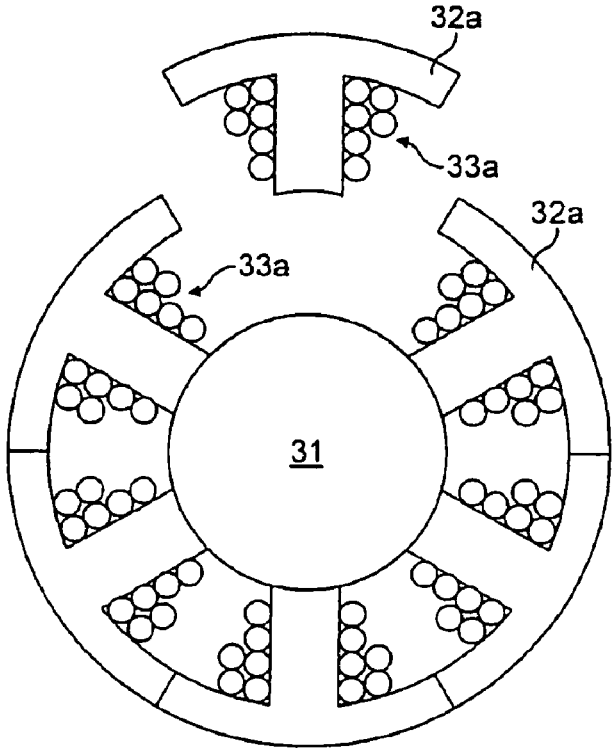

In a manner similar to that described with respect to FIG. 5*a*, the reactors shown in FIGS. 7 and 8 may be split or separated to form generally "T" section segments 32*a* as shown in FIGS. 7*a* and 8*a*. The windings 33*a* can then easily be wound on the "stems" of the separated T-section parts. After the windings 33*a* have been wound, the separated core parts are re-assembled together.

Figure 7B:
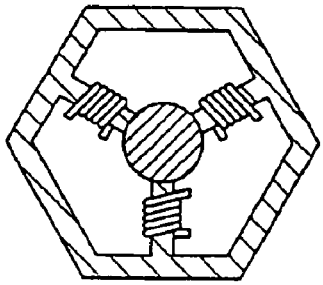
Figure 7C:
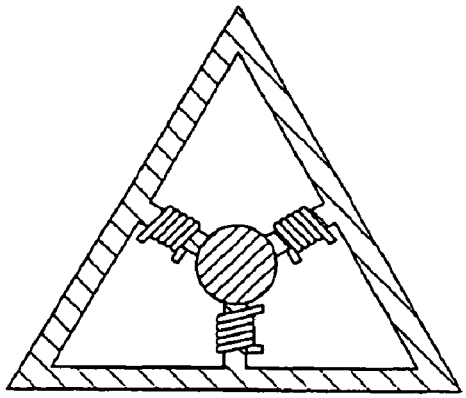

If the outer core parts are made from laminated electrical steel, they can have various different shapes. FIGS. 7*b* and 7*c* show reactors that are generally hexagonal and generally triangular respectively.

FIG. 9 shows a reactor in which the phase windings 43 are intermixed and are arranged in slots between teeth 42 of the core 32. The teeth 42 abut the body 31.

Manufacture of the reactors shown in FIGS. 7 to 9 is simplified by relying on established techniques for dimensioning and manufacturing stators and windings of machines and providing cooling. There is no restriction on the length of the device and flux leakage at the ends can be reduced, relative to the total magnetic flux, by making the device longer. The reactor is preferably open at its ends and this means that the body 31 can be exchanged for a body having a different magnetic permeability in order to vary the inductance of the reactor. The acoustic, strength and flux shielding characteristics of these reactors are favourable.

Figure 10:
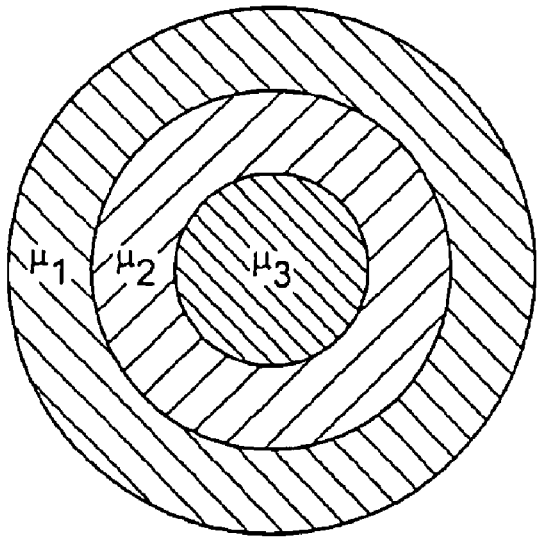
FIG. 10 is a cross sectional view of a distributed air gap material body for optional use with the reactor of FIG. 9.
Figure 11:
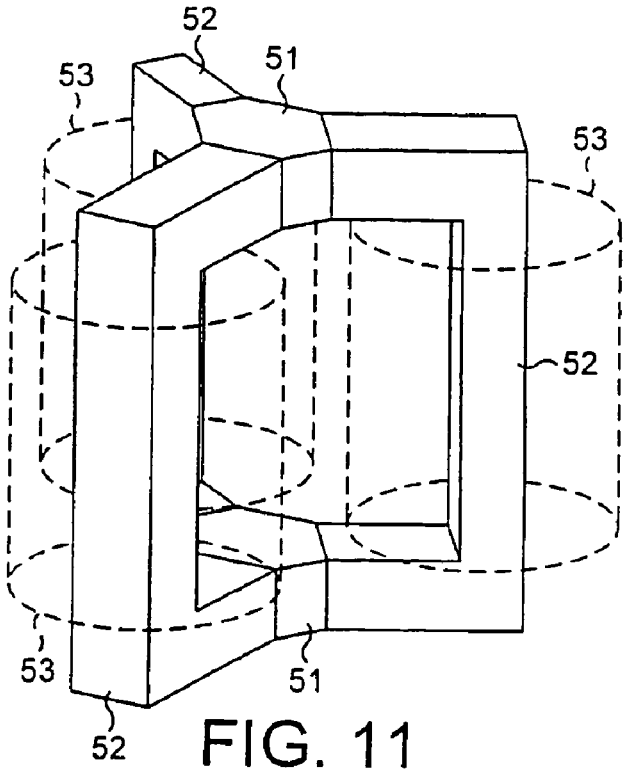
FIGS. 11, 12 and 13 are schematic perspective views of reactors according to seventh, eighth and ninth embodiments of the invention respectively.

FIG. 10 shows a distributed air gap material body for optional use in the reactor of FIG. 8, 9 or 11. It has three concentric annular regions of different magnetic permeability $\mu 1$, $\mu 2$, $\mu 3$ with $\mu 3$ innermost and $\mu 1<\mu 2<\mu 3$. The concentric regions are formed by concentrating the magnetic particles more greatly in the intermediate region than the outermost region and still more greatly in the innermost region. In this body the magnetic permeability is better adapted to the spatial variations of the magnetic field, thus allowing the size of the body in FIG. 10 to be considerably reduced when the field vector is rotating. Additionally, reduced losses should occur in the distributed air gap material due to the even field distribution.

FIG. 11 shows a further embodiment of reactor also producing a rotating magnetic field. Three C-shaped core limbs 52 abut hexagonal distributed air gap bodies 51 at either end. The core limbs may comprise conventional electrical steel or alternatively include any of magnetic wires, magnetic ribbon and compacted magnetic powder. The core limbs 52 are spaced at equal angles and have parallel sections around which windings 53 (shown schematically by dotted-line cylinders) are arranged. Alternatively the core limbs may be somewhat pointed, instead of having a uniform cross-section, near the air gap bodies 51. Additionally the parts of core limbs 52 nearest the bodies 51 may include slits.

Figure 11A:
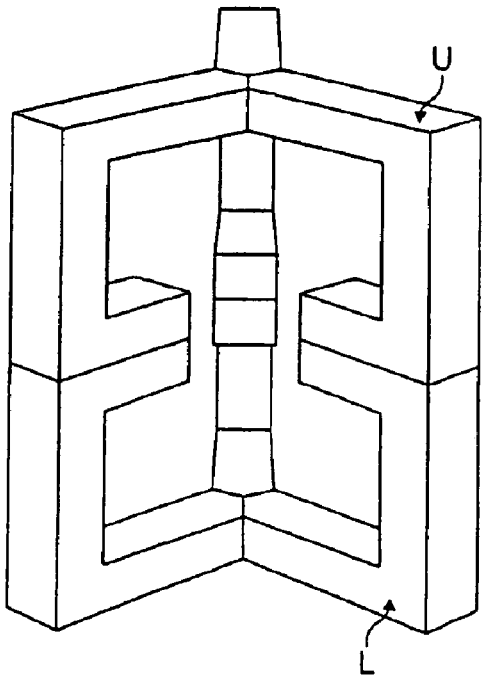
FIG. 11*a* is a schematic perspective views of a modified version of the reactor shown in FIG. 11.
Figure 11B:
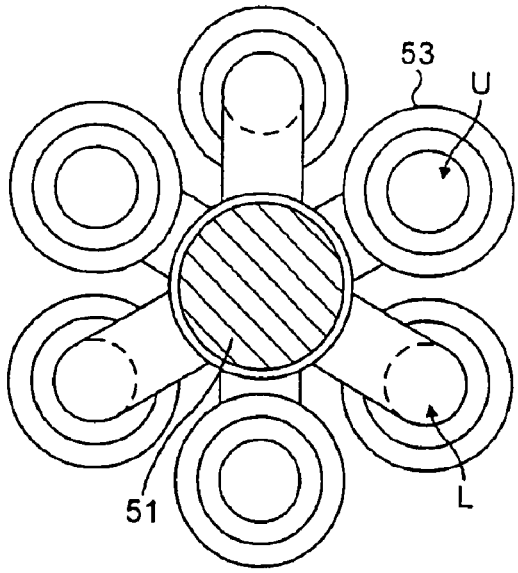
FIG. 11*b* is a schematic transverse section through a modified version of the reactor shown in FIG. 11*a;*

FIG. 11*a* shows a modified version of the reactor shown in FIG. 11, having two identical core halves U, L, each comprising three C-shaped core limbs which are joined at one end. At the other end, the respective core limbs of the core halves U, L abut each other in a face-to-face manner and all the limbs are connected by a single distributed air gap body (not shown). The core halves can be formed in one piece and are easy to lift apart for access to the body. There is only one iron-powder interface per phase, and magnetic flux leakage to the environment is reduced, the magnetic energy being better confined. FIG. 11*b* shows, in transverse section, a further modification in which the core halves U, L have been shifted by 60° with respect to each other and moved towards each other. A distributed air gap material body 51*a* is circular in cross-section.

Figure 12:
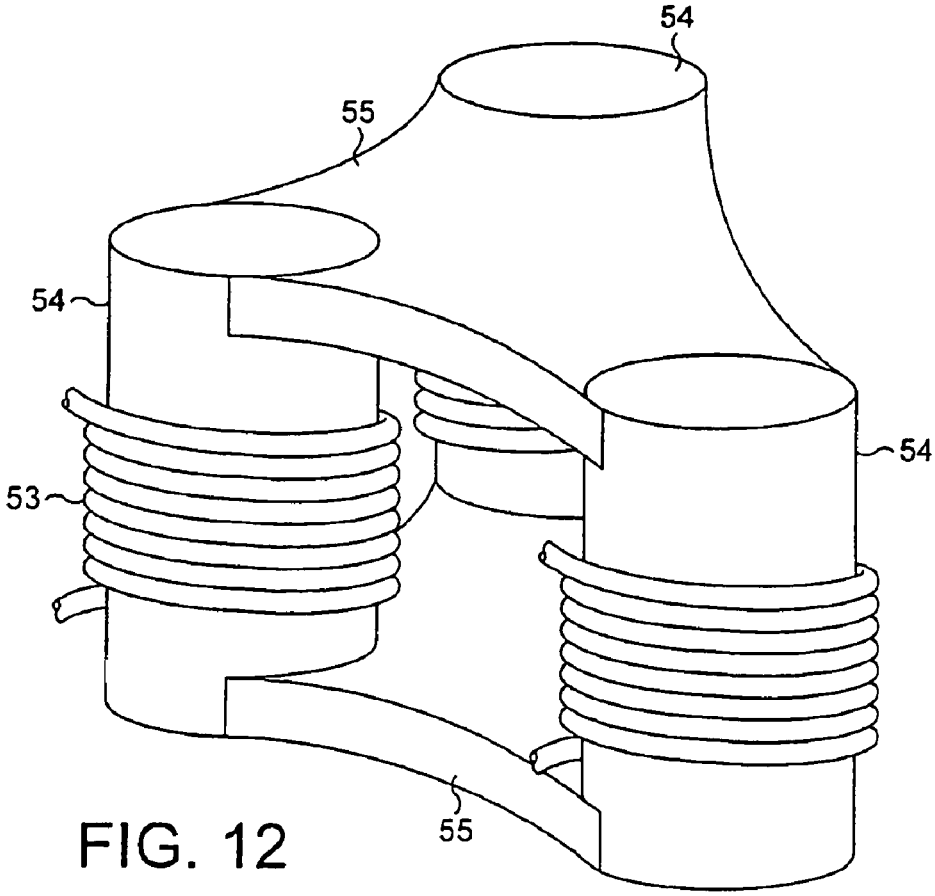

FIG. 12 shows an alternative reactor comprising three parallel core limbs 54 and two distributed air gap material bodies 55, having a shape between triangular and Y-shaped, directly connected at the ends of the core limbs 54. Production of such a reactor is relatively easy and the mass of the iron or other magnetic material forming the core limbs 54 is reduced as compared to the reactor of FIG. 11.

Figure 13:
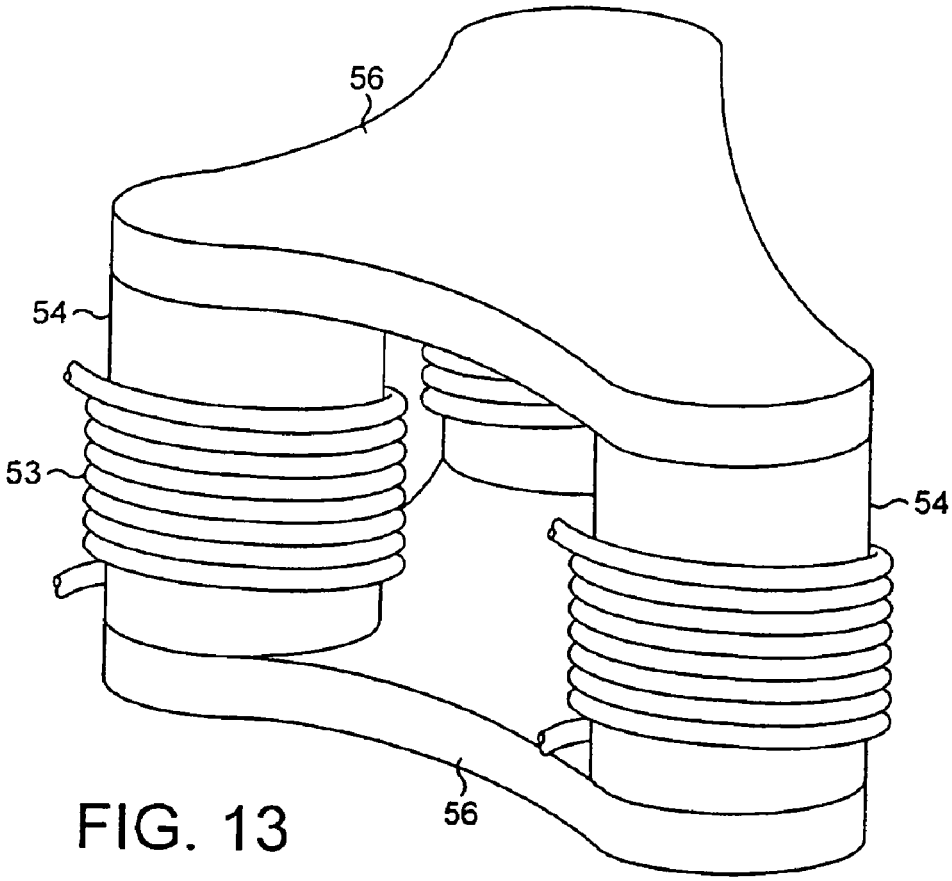

FIG. 13 shows a variant of the reactor shown in FIG. 12 in which a distributed air gap material body 56 interconnects the end faces of the three core limbs 54 at either end of each limb. The core limbs are, for example, made from oriented grain electrical steel. Stray magnetic fields in this reactor are lower than those of the reactor of FIG. 12, since the magnetic field at the ends of the core limbs enters directly into the distributed air gap material body 56. The amount of magnetic flux leaving the iron core in a direction orthogonal to the plane of magnetic direction or lamination is reduced, since there is no magnetically active material in the region between the limbs.

The inductance of the reactors shown in FIGS. 11, 12 and 13 can optionally be made variable without incurring additional losses, if the core limbs 52, 54 are movable radially in and out. As further options, interchangeable distributed air gap bodies of different sizes can be used in the reactor of FIG. 11, and in the reactor of FIG. 13, the distributed air gap material bodies 56 could be movable away from and towards the limbs 54.

Figure 14:
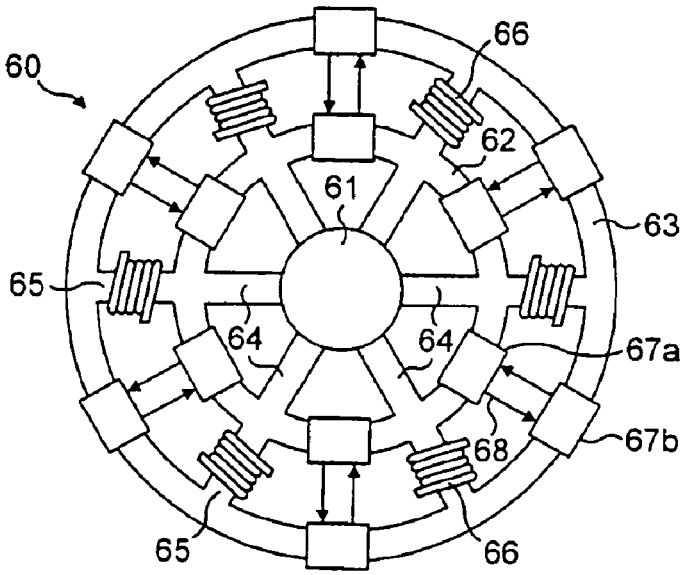
FIG. 14 is a schematic view of a high voltage induction device in the form of a reactor according to a tenth embodiment.

In an alternative embodiment of the invention, a high voltage induction device is provided in the form of a reactor 60 (see FIG. 14). The reactor 60 has a central, stationary prismatic or cylindrical body 61 of distributed air gap material, a surrounding cylindrical inner core part 62 and a surrounding cylindrical outer core part 63. Six radial core limbs 64 connect the inner core part 62 to the body 61 and six further radial core limbs 65 connect the inner and outer core parts 62 and 63. Phase windings 66 are wound on the radial core limbs 65. The space between the parts of the magnetic core may, if required, be filled with a material (not shown) having a magnetic permeability of approximately 1, or between 0 and approximately 1.

The core parts 62 and 63 and core limbs 64 and 65 are suitably made of high permeability material. For example, they may be made from a material of high magnetic permeability such as iron, laminated electrical steel, magnetic wires or ribbons, or highly compacted soft magnetic powder.

Figure 15A:
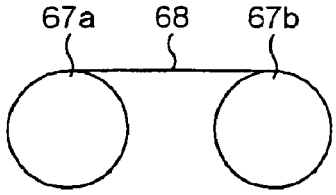
FIGS. 15*a* and 15*b* are alternative schematic views showing how regulating windings can be wound in the same or different directions on inner and outer drums of a high voltage induction device.
Figure 15B:
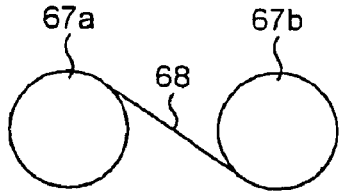

The inner and outer core parts 62 and 63 have six pairs of drums 67*a* and 67*b* rotatably mounted thereon for transferring conductor means 68 between the drums of each pair. Adjustment or transfer means (not shown) are provided to rotate the drums so as to enable the conductor means 68 to be unwound from one drum of a pair and wound onto the other drum of the pair. In this manner the amount of the conductor means 68 wound on the inner drum 67*a* (or outer drum 67*b*) of a drum pair can be adjusted as required to vary the magnetic flux path of the magnetic core 3, and thus the electrical properties of the rotary machine. In particular, for each drum pair, the conductor means 68 may be fully wound on the inner drum 67*a*, fully wound on the outer drum 67*b* or partially wound about both the inner and outer drums 67*a* and 67*b*. There may be six pairs of drums whether the number of phases is 6 or other than 6. The conductor means 68 may be wound in the same or in different directions on the two drums. Thus FIG. 15*a* shows how the conductor means 68 is transferred from the inner drum 67*a* to the outer drum 10*b* whilst still being wound on the respective drums in the same sense. In FIG. 15*b*, however, an arrangement is shown for having the windings wound in different directions on the two drums 67*a* and 67*b*. It will be appreciated that a different inductive effect is obtained by winding the conductor means 68 between the two drums so that they are wound either in the same or different directions.

A major advantage of this embodiment of the invention is that it allows the regulation of the reactor, or transformer as the case may be, to be separated from the electrical part of the reactor or transformer.

The reactors of FIGS. 11, 12, 13 and 14 can use known cable winding technology. Particularly suitable are extruded cables in which central strands of wire are surrounded in turn by first semiconducting, insulating and second semiconducting polymeric layers. In such a reactor insulating oil is not required and vertical air cooling can be used.

Figure 16:
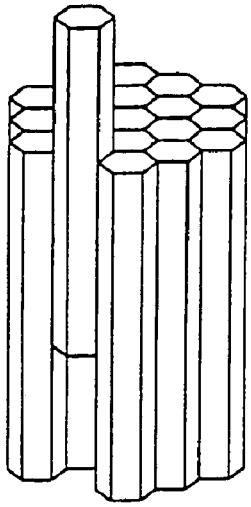
FIGS. 16, 17 and 18 are schematic perspective views of distributed air gap material bodies for optional use with the reactors of FIGS. 7 to 14.
Figure 17:
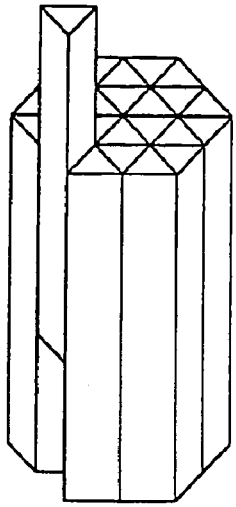
Figure 18:
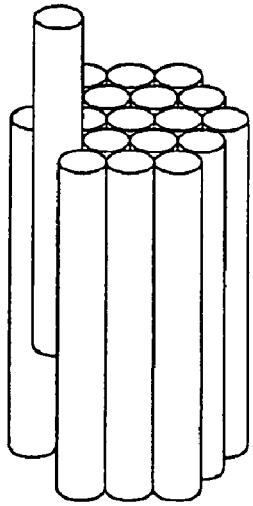

FIGS. 16, 17 and 18 show bodies each formed from a number of members of distributed air gap material with substantially uniform cross-section. In FIG. 16, the members are hexagonal, in FIG. 17, triangular and in FIG. 18, circular. Each member comprises a strand of solid material, or one or more wires, or a powder filled hose or pipe, or a roll of ribbon.

Figure 19:
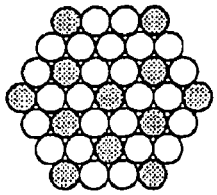
FIGS. 19, 20 and 21 show alternative arrangements of magnetic permeability for the bodies of FIGS. 16, 17 and 18.
Figure 20:
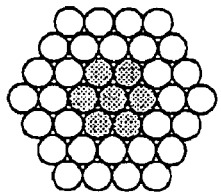
Figure 21:
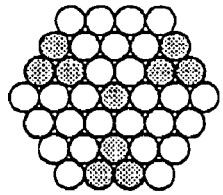

As shown in FIGS. 19, 20 and 21, some of the members of uniform cross-section in any of FIGS. 16, 17 and 18 have a different magnetic permeability from others. In particular, the dark circles represent members of greater magnetic permeability than the white circles. FIG. 19 shows a body formed from an "alloy" of the two kinds of member, FIG. 20 shows a body in which the magnetic permeability varies radially in cross section, and FIG. 21 a body in which the magnetic permeability varies angularly. The bodies shown in FIGS. 16 to 21 can be used in the reactors of FIGS. 7, 8, 9 and 11; their compact structure is ideal for the threefold or sixfold symmetry of the reactor. By making the bodies cylindrical, any of them can also be used in the reactor of FIG. 9 or 14. It will be appreciated that different distributed air gap material bodies for the reactors of FIGS. 12 and 13 or for any other reactor according to this invention can easily be customized.

In an alternative distributed air gap material body of substantially uniform cross-section, transition regions at the ends have a higher magnetic permeability than the centre of the body.

Whilst the specific embodiments described above are three- and six-phase reactors, it will be appreciated that by making modifications which will be readily apparent to those skilled in the art, reactors and transformers having any reasonable number of phases can be provided.

The invention claimed is:

1. A high voltage multiphase reactor for power systems, comprising:

an outer core;

phase windings arranged in stator slots between teeth of the outer core;

a cylindrical body enclosed by said outer core and formed from magnetic particles in a matrix of a dielectric material; and said cylindrical body configured to have therein a rotating magnetic field.

2. The reactor of claim 1, wherein the magnetic particles comprise an alloy selected from the group comprising Ni—Fe, Co—Fe and Fe—Si.

3. The reactor of claim 1, wherein the dielectric material is selected from at least one of an epoxy resin, polyamide, polyimide, polyethylene, cross-linked polyethylene, polytetrafluoroethylene, polyformaldehyde, rubber, ethylene propylene rubber, acrylonitrile-butadiene-styrene, polyacetal, polycarbonate, polymethyl methacrylate, polyphenylene sulphone, polysulphone, polyetherimide, polyetheretherketone, concrete, foundry sand, and a fluid.

4. The reactor of claim 1, wherein the magnetic particles have a size from about 1 nm to about 1 mm.

5. The reactor of claim 1, wherein the magnetic particles have a size from 0.1 μm to 200 μm.

6. The reactor of claim 1, wherein the magnetic particles are coated with an inorganic compound.

7. The reactor of claim 1, wherein the cylindrical body is configured to be removable for replacement with bodies of different magnetic permeability.

8. The reactor of claim 1, wherein the cylindrical body exhibits anisotropy in its magnetic permeability.

9. The reactor of claim 1, wherein the cylindrical body comprises concentric regions of greater and lower magnetic permeability.

10. The reactor of claim 1, wherein the cylindrical body is formed from a plurality of members of uniform cross-section, at least one of the members having a different magnetic permeability from the others.

11. The reactor of claim 10, wherein the members comprise strands of solid material, wires, powder filled hoses or pipes, or rolls of ribbon.

12. The reactor of claim 1, wherein the outer core comprises laminated electrical steel.

13. The reactor of claim 1, further comprising:

a connection to a high voltage supply.

* * * * *